US005774154A

United States Patent [19]

Underwood

[11] Patent Number: 5,774,154

[45] Date of Patent: Jun. 30, 1998

[54] APPARATUS FOR PRIMING AN INK DELIVERY SYSTEM IN AN INK-JET PRINTER

[75] Inventor: John A. Underwood, Vancouver, Wash.

[73] Assignee: Hewlett-Packard Company, Palo Alto, Calif.

[21] Appl. No.: 610,821

[22] Filed: Mar. 7, 1996

[51] Int. Cl.[6] ..... B41J 2/175

[52] U.S. Cl. ..... 347/85; 137/150

[58] Field of Search ..... 347/30, 84, 85, 347/86, 87; 222/152; 137/150, 148, 143

[56] References Cited

U.S. PATENT DOCUMENTS

| | | | |
|---|---|---|---|
| 4,187,511 | 2/1980 | Robinson | 347/85 |
| 4,234,885 | 11/1980 | Arway | 347/85 |
| 4,383,263 | 5/1983 | Ozawa et alo. | 347/30 |
| 5,367,328 | 11/1994 | Erickson | 347/85 |
| 5,446,486 | 8/1995 | Reis | 347/85 |

FOREIGN PATENT DOCUMENTS

| | | | |
|---|---|---|---|
| 2-122940 | 5/1990 | Japan | 347/30 |

*Primary Examiner*—N. Le
*Assistant Examiner*—Judy Nguyen

[57] ABSTRACT

An ink delivery system with purging/priming apparatus is provided, the apparatus including a pump mechanism for automatically maintaining a nominally positive air pressure within the conduit during shipping of the ink-jet printer thereby to ensure that no ink is contained within the conduit during shipping, and for automatically priming the conduit at the time of installation of the printer at a customer site to fill the conduit with a column of ink extending between an ink source such as a reservoir and an ink destination such as a pen.

8 Claims, 1 Drawing Sheet

APPARATUS FOR PRIMING AN INK DELIVERY SYSTEM IN AN INK-JET PRINTER

TECHNICAL FIELD

The present invention relates generally to ink delivery systems for wet-ink printers. More specifically, the invention concerns an apparatus for priming the ink delivery system to fill the conduit with ink prior to placing the printer in service.

BACKGROUND ART

In a conventional ink-jet printer, one or more ink delivery conduits extending between an ink reservoir and a ink cartridge is filled with ink when the printer is assembled and final tested. The printer then is stored for an indeterminate period of time prior to installation at a customer's site. Wet ink tends to dry and form viscous plugs, especially when the ink has not flowed through the conduit for extended periods of time. An undesirable effect of shipping or extended storage of an ink-jet printer thus is the partial drying of a stationary volume of ink which may be stored within the ink delivery conduit. It thus would be preferable to ship or store ink-jet printers with the ink delivery conduit filled with air rather than ink. However, where the conduit contains air a similarly undesirable effect of shipping or extending storage is the passage of such air through the ink cartridge when the printer is eventually used. Either effect may lead to less than optimal print quality.

DISCLOSURE OF THE INVENTION

Briefly, the invention involves providing an ink delivery system with apparatus that preferably provides a pump mechanism for automatically priming the conduit at the time of installation of the printer at a customer site by filling the conduit with a column of ink extending between an ink source such as a reservoir and an ink destination such as a pen or cartridge, or another downstream mechanism such as a humidor. The pump mechanism also preferably automatically maintains a nominally positive air pressure within the conduit during shipping of the ink-jet printer, thereby to ensure that no ink is contained within the conduit during shipping. The pump mechanism typically includes a mechanically-actuated bellows, responsive to an initial power-on sequence of the printer or responsive to a manual command from the operator. The pump mechanism also typically includes a check valve for preventing air evacuated into the bellows from bleeding back into the ink-filled conduit and, perhaps more importantly, for preventing pressurized ink (including ink volatiles) within the conduit from bleeding into the bellows. The invented apparatus involves a semi-automatic or automatic transition of the printer from a pressurized phase to a depressurized phase of the printer's operation.

Thus, a principal object of the invention is to prevent wet ink from filling an ink delivery system's conduit during shipping and extended ink-jet printer storage, thereby to avoid drying of or plug-forming in the ink.

Another object is to prime the printer at the time of installation, preferably automatically, thereby to fill the conduit with ink.

Yet another object is to prime the printer utilizing the same pump mechanism as that which previously was utilized to maintain air rather than ink within the conduit.

One more object of the invention is to use a pump mechanism that includes a simple mechanically actuated bellows in fluid communication with the conduit for maintaining an ambient air pressure within the conduit during shipping, and to prime the ink to flow through the conduit from the ink reservoir to the ink pen or cartridge at the time of printer installation.

A related object is to render the pump mechanism automatically actuated at the time of printer installation by operatively coupling the bellow's drive element with a portion of the printer such as a latch mechanism that is moved by an operator during installation of the printer.

Still another object is to provide the pump mechanism with a check valve to prevent air from bleeding from the bellows back into the ink-filled conduit during the normal operation of the printer.

Further objects of the invention include providing a simple mechanism that is cost-effective and easy to manufacture and to operate.

These and other objects and advantages of the present invention will be more readily understood after a consideration of the drawings and the detailed description of the preferred embodiment which follows.

DETAILED DESCRIPTION OF THE PREFERRED EMBODIMENTS AND BEST MODE FOR CARRYING OUT THE INVENTION

Figure 1:
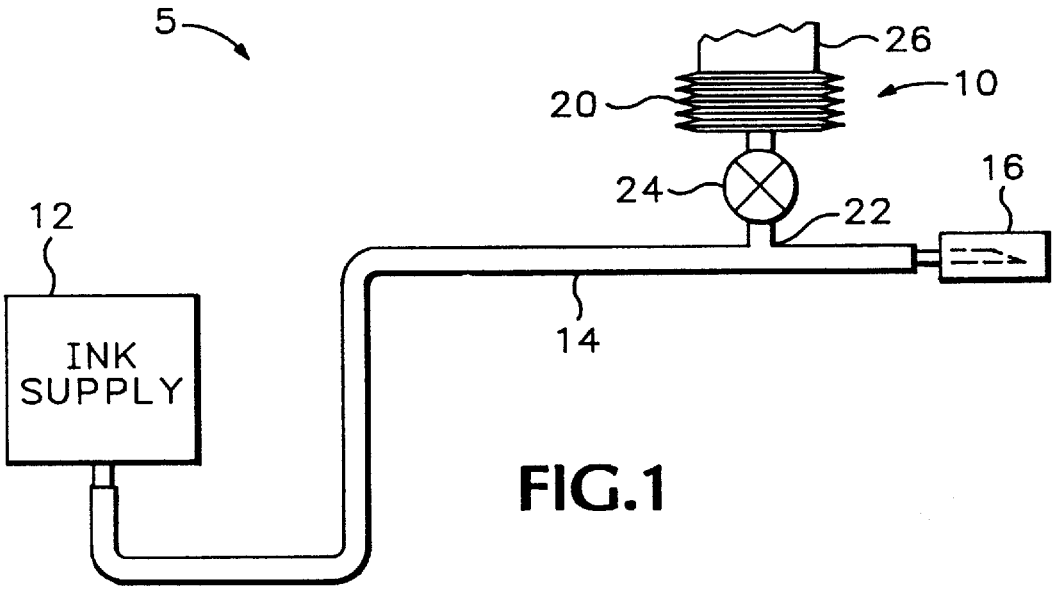
FIG. 1 is fragmentary front elevational view of an ink delivery system equipped with a priming apparatus constructed in accordance with a preferred embodiment of the invention, such apparatus being shown in a first phase of its operation.
Figure 2:
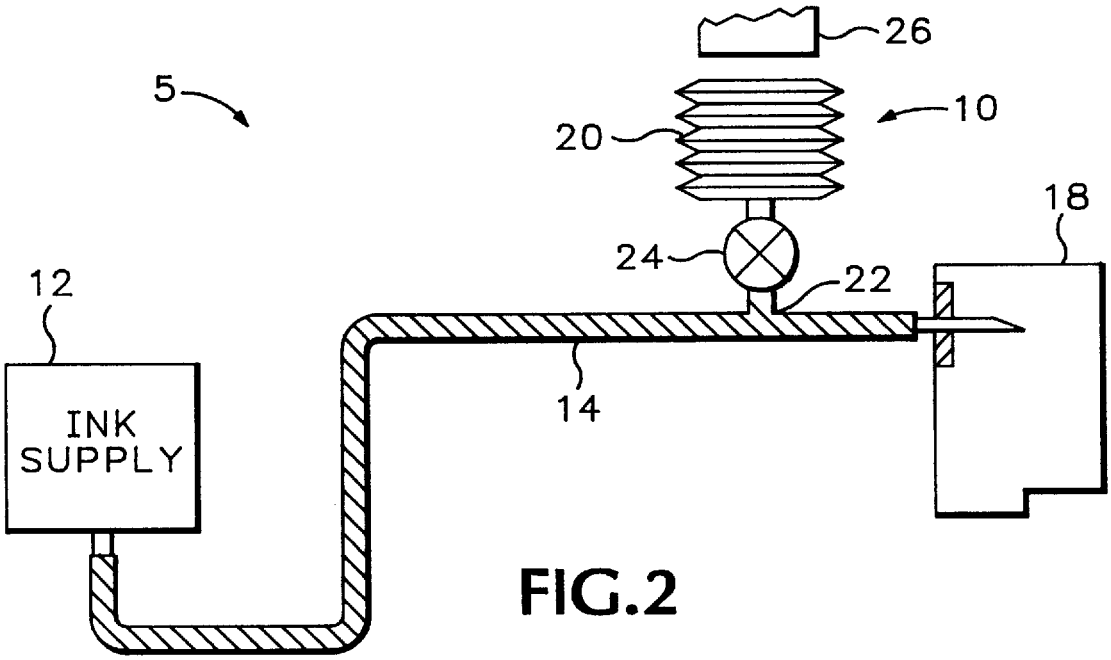
FIG. 2 is a front elevational view corresponding to FIG. 1, but showing the apparatus in a second phase of its operation.

An ink delivery system constructed in accordance with the present invention is depicted at 5 in FIGS. 1 and 2, such system including a priming apparatus 10 whereby an ink-jet printer is prepared either for shipping and storage, or for operation. FIG. 1 shows the apparatus in an ink-purging phase of its operation which accommodates shipping or storage of the associated ink-jet printer. FIG. 2 shows the apparatus in an ink-priming phase of its operation which accommodates operation of the associated ink-jet printer.

It will be appreciated by those of skill in the art that, like most wet ink delivery systems, ink delivery system 5 employs an upstream ink pump (not shown) which forces ink from an upstream ink supply (such as ink reservoir 12), through an ink delivery conduit 14, and to a downstream destination (such as a humidor 16 or a pen 18). The ink pump typically establishes a properly pressurized, continuous flow of ink from the ink supply to the ink destination when the printer is in operation, but need not pressurize the conduit when the printer is not in operation. In fact, prior to set-up, the conduit typically is filled with air, not ink. Thus, ambient pressure typically exists in the conduit during shipping and storage. It will be understood, however, that a positive pressure may be delivered to the conduit by apparatus 10 in order to purge the conduit, or to keep the ink delivery conduit clear of ink when the printer is not in operation. Further, only a slight negative pressure need be provided to prime the ink delivery conduit when the printer is prepared for operation.

As indicated, apparatus 10 includes a purge/prime pump mechanism in the form of a mechanically-actuated bellows 20 which is sized to receive a volume of air generally in accordance with a volume of air which would fill conduit 14 at an ambient pressure, or at a nominal positive pressure. Such a nominal positive pressure may be desirable in conduit 14 when preparing for shipping and storage of an ink-jet printer so as to keep the conduit free of ink during shipping and storage, and perhaps, to purge the conduit of ink from the ink supply.

In the depicted embodiment, bellows 20 is connected to conduit 14 via a T-coupling 22. As indicated in FIG. 1, bellows 20 may be compressed to produce a nominal positive pressure in conduit 14 (i.e., an ink-purging configuration) wherein the conduit is free of ink. The bellows, however, similarly may be compressed with ambient pressure in the conduit. In either case, bellows 20 may be expanded to draw ink from the ink supply and into the conduit as shown in FIG. 2 (i.e., an ink-priming configuration). The air previously within the conduit thus is drawn into the bellows, rather than forced through the ink cartridge or pen.

Bellows 20 typically is formed from a resilient material having a high memory which nominally configures the bellows in a fully-expanded orientation (FIG. 2). However, the bellows may be compressed to a fully-compressed orientation. It thus will be appreciated that bellows 20 may be rendered in the accordion style, as shown in FIGS. 1 and 2, and may be formed of polyethylene or any other suitable material that is relatively flexible and minimally permeable to air and ink.

Of course, bellows 20 may take alternative forms. For example, it may be made of metalized film staked (welded) to the wall of an extremely thin, flexible polyethylene bag that is expandable and compressible by a drive member. This and other alternative bellows forms are contemplated, and are within the spirit and scope of the invention.

Preferably, apparatus 10 includes a check valve 24 capable of substantially impeding, and most-preferably preventing, the flow of air from bellows 20 into conduit 14. The check valve preferably also is capable of substantially impeding, and most preferably preventing, the flow of ink from conduit 14 into bellows 20. The check valve may be automatically actuated, or may be actuated manually so as to provide for user-selected opening and closure thereof. Check valve 24 is of somewhat conventional design, and may be located immediately adjacent bellows 20, or may form a part of bellows 20 without departing from the invention as claimed. In one embodiment of the invention, the check valve is open only during shipping and initial set-up, such valve closing automatically upon expansion of bellows 20.

It is believed that check valve 24 prevents volatile ink constituents from entering bellows 20, so that there is no risk of escape of volatiles therefrom. Nevertheless, if desired, an impermeable enclosure may be made to surround bellows 20 thereby to ensure against such escape and possible printer, user or environmental contamination.

Bellows 20 typically is operated using a movable drive member 26. During shipping and storage of the printer, the drive member is normally in an impingement position (FIG. 1) in which the bellows is compressed such that the interior volume of the bellows is minimized. When the printer is set up for operation (as by an initial power-on sequence), the drive member is moved (preferably automatically) to a predetermined non-impingement position (FIG. 2) in which the bellows is allowed to expand to maximize the interior volume of the bellows. Bellows 20 thus preferably is changed from its compressed to its expanded configuration by drive member 26, which may be operatively connected to an existing printer element. Such existing printer element may be a latch mechanism which locks the ink cartridges in place on the printer's carriage, or it may be the latch mechanism which locks the needles of the individual ink tubes into the ink cartridges, or it may be any other mechanism that lends itself to ready actuation by the user who is installing the printer.

Briefly contrasting FIGS. 1 and 2, it will be understood that FIG. 1 shows apparatus 10 with bellows 20 in a compressed configuration in which drive member 26 impinges on the bellows to minimize the interior volume of the bellows, and FIG. 2 shows apparatus 10 with drive member 26 removed from impingement on the bellows to allow the bellows to expand, and thereby to maximize the interior volume of the bellows. It also will be appreciated by those skilled in the art that placement of the bellows in the expanded configuration creates a vacuum (or negative pressure) in conduit 14 via T-coupling 22, thus drawing air from conduit 14 into the interior of bellows 20.

It also is possible, within the spirit and scope of the invention to render fully automatic the invented apparatus by appropriately programming the printer's firmware to actuate drive member 26 under motor control responsive to the firmware's detection that the printer is being installed (as by the user entering an "AUTO-INSTALL" or "AUTO-CONFIGURE" key on the console or by some other suitable means).

The invented apparatus now may be understood to be intended for use in an ink-jet printer including an ink delivery conduit extending between an upstream ink supply and a downstream ink destination. The apparatus selectively purges and primes the conduit, preferably via a pump mechanism (e.g., bellows 20) which is in fluid communication with the ink delivery conduit as described and illustrated herein. The pump mechanism is configured for use in a first mode of operation wherein the apparatus is capable of pressurizing the conduit to prevent the flow of ink from the ink supply (e.g., an ink reservoir) to the ink destination (e.g., an ink pen), and is configured for use in a second mode of operation wherein the apparatus is capable of vacuuming the conduit to promote the flow of ink from the ink supply to the ink destination. An actuator (e.g., drive member 26) operatively connects to the pump mechanism to control the mode of operation thereof.

Although bellows 20 may be located virtually anywhere between an upstream ink source and a downstream ink destination the bellows most preferably will be positioned close to the ink designation so as to most effectively evacuate air from the conduit when the conduit is primed. While such an ink supply is described in the context of the preferred embodiment of the invention to be an ink reservoir and the ink destination is described herein to be an ink pen, it will be understood that alternative sources and destinations are contemplated, and are within the spirit and scope of the invention.

Industrial Applicability

Those of skill in the art will appreciate that apparatus 10 is useful in any wet ink printer application in which it is desired to ship and store an ink delivery conduit dry and then to fill such a conduit with ink at least semi-automatically during installation of the printer. Accordingly, it may be appreciated that the invented apparatus renders the shipping and storage of an ink-jet printer less troublesome by preventing ink drying and plugging within the ink delivery conduit extending from the ink reservoir to the ink pen or cartridge. Yet it accomplishes the objects of the invention at extremely low cost and without unnecessarily burdening the customer or field service technician who installs the printer because of its preferably simple, semi-automatic actuation as part of the normal printer installation procedure. The apparatus advantageously provides successive phases of operation in which the ink conduit first is pressurized by a compressed bellows that creates an ambient or nominally positive air pressure in the conduit during shipping, and in which the ink conduit is primed with ink by an expanded bellows which creates a negative air pressure within the conduit upon installation of the printer for normal use.

While the present invention has been shown and described with reference to the foregoing operational principles and preferred embodiment, it will be apparent that to those skilled in the art that various changes in form and detail may be made without departing from the spirit and scope of the invention as defined by the appended claims.

I claim:

1. For use in an ink-jet printer including an ink delivery conduit extending between an up ink source and a downstream ink destination, an apparatus for selectively priming the conduit, the apparatus comprising:

a pump mechanism in fluid communication with the ink delivery conduit, said pump mechanism selectively vacuuming air from the conduit to promote ink flow from the ink source to the ink destination;

a check valve in fluid communication with and intermediate said pump mechanism and the conduit for selectively inhibiting air flow from said pump mechanism into the conduit; and an actuator operatively connected with said pump mechanism for selectively directing said pump mechanism to vacuum air from the conduit.

2. The apparatus of claim 1, wherein said actuator includes a movable drive member and said pump mechanism includes a bellows selectively actuable to prime the conduit in response to predetermined movement of said drive member.

3. For use in an ink-jet printer including an ink delivery conduit extending between an upstream ink source and a downstream ink destination, an apparatus for selectively pressurizing and depressurizing the conduit, the apparatus comprising:

a pump mechanism in fluid communication with the ink delivery conduit, said pump mechanism in a first mode of operation pressurizing the conduit with air, sad pump mechanism in a second mode of operation vacuuming the conduit to promote ink flow from the ink source to the ink destination; and an actuator operatively connected with said pump mechanism for controlling the first mode and second mode of operation thereof.

4. The apparatus of claim 3, wherein said pump mechanism includes a bellows selectively actuable to assume a position for pressurizing and depressurizing in response to manual actuation by a printer operator.

5. The apparatus of claim 3, wherein said actuator includes a moveable drive member and said pump mechanism includes a bellows selectively actuable to assure positions for pressurizing and depressurizing automatically in response to predetermined movement of said drive member.

6. The apparatus of claim 3 which further comprises a check valve in fluid communication with and intermediate said pump mechanism and said conduit for selectively inhibiting air flow from the pump mechanism into the conduit.

7. The apparatus of claim 3 which further comprises a check valve in fluid communication with and intermediate said pump mechanism and said conduit for selectively inhibiting ink drawn from the conduit from flowing into said pump mechanism.

8. For use in an ink-jet printer including an ink delivery conduit extending between an upstream ink source and a downstream ink destination, an apparatus for selectively purging and priming the conduit, the apparatus comprising:

a pump mechanism including a bellows in fluid communication with the ink delivery conduit, said bellows selectively compressing to direct air into the conduit, thereby purging the conduit, and said bellows selectively expanding to draw air out of the conduit, thereby priming the conduit;

a check valve in fluid communication with and intermediate said bellows and the conduit for selectively inhibiting air flow from said bellows into the conduit, and for selectively inhibiting ink flow from the conduit into the bellows; and an actuator including a movable drive member selectively compressing and expanding said bellows to effect purging and priming of the conduit upon predetermined movement of the drive member.

* * * * *

UNITED STATES PATENT AND TRADEMARK OFFICE

CERTIFICATE OF CORRECTION

PATENT NO. : 5,774,154

DATED : June 30, 1998

INVENTOR(S) : Underwood

It is certified that error appears in the above-identified patent and that said Letters Patent is hereby corrected as shown below:

In the Claims

Column 5 (line 23), delete "up" and insert therefor -- upstream --.

Column 6 (line 1), delete "sad" and insert therefor -- said --.

Column 6 (line 15), delete "assure" and insert therefor -- assume --.

Signed and Sealed this

Twenty-third Day of February, 1999

*Attest:*

Q. TODD DICKINSON

*Attesting Officer*

*Acting Commissioner of Patents and Trademarks*